US009583329B2

(12) United States Patent
Yeh

(10) Patent No.: US 9,583,329 B2
(45) Date of Patent: Feb. 28, 2017

(54) INDUCTION BULB EXTENDABLE ADAPTER

(71) Applicant: John Yeh, Chino Hills, CA (US)

(72) Inventor: John Yeh, Chino Hills, CA (US)

( * ) Notice: Subject to any disclaimer, the term of this patent is extended or adjusted under 35 U.S.C. 154(b) by 334 days.

(21) Appl. No.: 14/557,395

(22) Filed: Dec. 1, 2014

(65) Prior Publication Data

US 2016/0153642 A1 Jun. 2, 2016

(51) Int. Cl.
*H01J 65/04* (2006.01)

(52) U.S. Cl.
CPC ..... *H01J 65/048* (2013.01)

(58) Field of Classification Search
CPC ..... H01J 65/048; F21V 19/009; F21V 23/02; F21V 23/001; F21S 8/06
See application file for complete search history.

(56) References Cited

U.S. PATENT DOCUMENTS

2011/0211342 A1* 9/2011 Sandoval ..... F21S 8/06
362/216

* cited by examiner

*Primary Examiner* — Sharon Payne
(74) *Attorney, Agent, or Firm* — Denis Khoo

(57) ABSTRACT

Disclosed herein is an adjustable induction lamp adapter that is also extendable. The adjustable induction lamp adapter attaches to an induction lamp by clamping onto an induction lamp bar. The clamping is achieved through the use of a removable end cap at the base of the adjustable induction lamp adapter, wherein the end cap has a cutout and screw to hold the induction lamp bar in place. The adjustable induction lamp adapter is designed to also be able to extend in length by attaching one or more extension adapters.

5 Claims, 8 Drawing Sheets

INDUCTION BULB EXTENDABLE ADAPTER

FIELD OF THE INVENTION

The present invention relates generally to a induction bulb adapter, and more particularly to an extendable induction bulb adapter.

DESCRIPTION OF RELATED ART

Induction lamps have many advantages over other conventional lamps. The primary difference between an induction lamp and a conventional lamp is that an induction lamp is electrode-less. Being electrode-less, induction lamps enjoy a longer life than conventional lamps that are dependent on an electrode. Generally, electrodes will end up failing in normal lamps, such as normal fluorescent lamps, shortening their life. In addition, induction lamps have a sealed tube, made possible by not having electrodes. As the tube can be perfectly sealed, induction lamps may also experience a longer life than conventional lamps because the gas cannot escape through worn out seals. Induction lamps are also very energy efficient, do not exhibit flickering, and are dimmable.

Due to the many advantages of induction lighting, there is a general desire to retrofit existing lighting systems with induction lamps. One of the most popular fitting systems for lamps is the Edison screw. There are existing means of connecting and powering an induction lamp to an Edison screw fitting. A popular means is with internal induction lamps, which tend to be more compact and styled like a conventional candescent light bulb. There are also existing means for connecting and powering an external induction lamp to an Edison style socket. One popular means is through the use of a round shaped external induction lamp attached to an adapter that allows the lamp to be connected and powered by an Edison style socket. The adapter generally is comprised of an Edison screw, connected to a cylindrical shaft, which is fixedly attached to the external induction lamp at the other end.

One popular application for induction lamp retrofitting is with high bay and low bay lighting systems. Due to the design of the high bay and low bay dome, the position of the induction lamp relative to the dome may significantly affect the effectiveness of the light refraction. With existing external induction lamp retrofits, the adapter has a fixed length, and is not adjustable. As such, to adjust the induction lamps position, the adapter must be replaced with an entirely different one with the appropriate shaft length. Though the desire of adjustability has been described with high and low bay lighting, there is a desire for adjusting the position of the induction lamp beyond high and low bay lighting. There is thus a desire within the industry for a more convenient and flexible means of adjusting the positioning of an external induction lamp.

BRIEF SUMMARY OF THE INVENTION

In a preferred embodiment, an induction lamp base adapter is capable of being screwed into an Edison style socket at one end and attached to an induction lamp at another end. Wiring which runs through the shaft of the adapter carries the current from the Edison style screw to the induction lamp. An end cap with a specialized shape and screw placement is utilized to securely clamp the adapter to an induction lamp bar. The induction lamp base adapter may be extended in length through the use of one or more extension adapters.

BRIEF DESCRIPTION OF THE DRAWINGS

A more complete appreciation of the invention and many of the advantages thereof will be readily obtained as the same becomes better understood by reference to the detailed description when considered in connection with the accompanying drawings, wherein.

DETAILED DESCRIPTION

Figure 1:
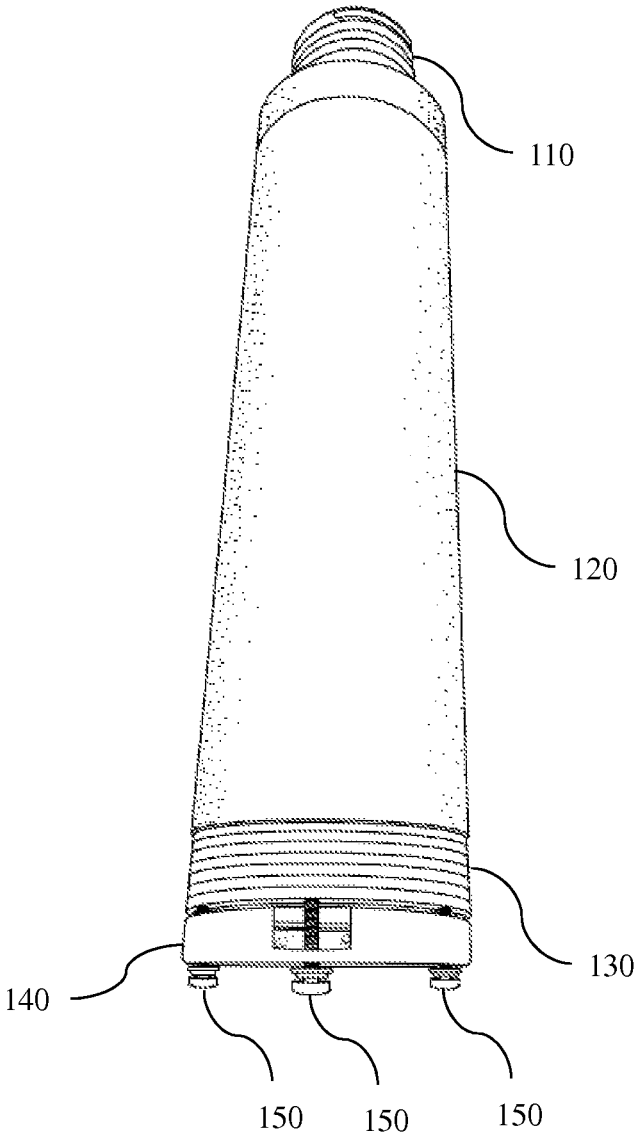
FIG. 1 is a side view of an embodiment of an induction lamp base adapter.
Figure 2:
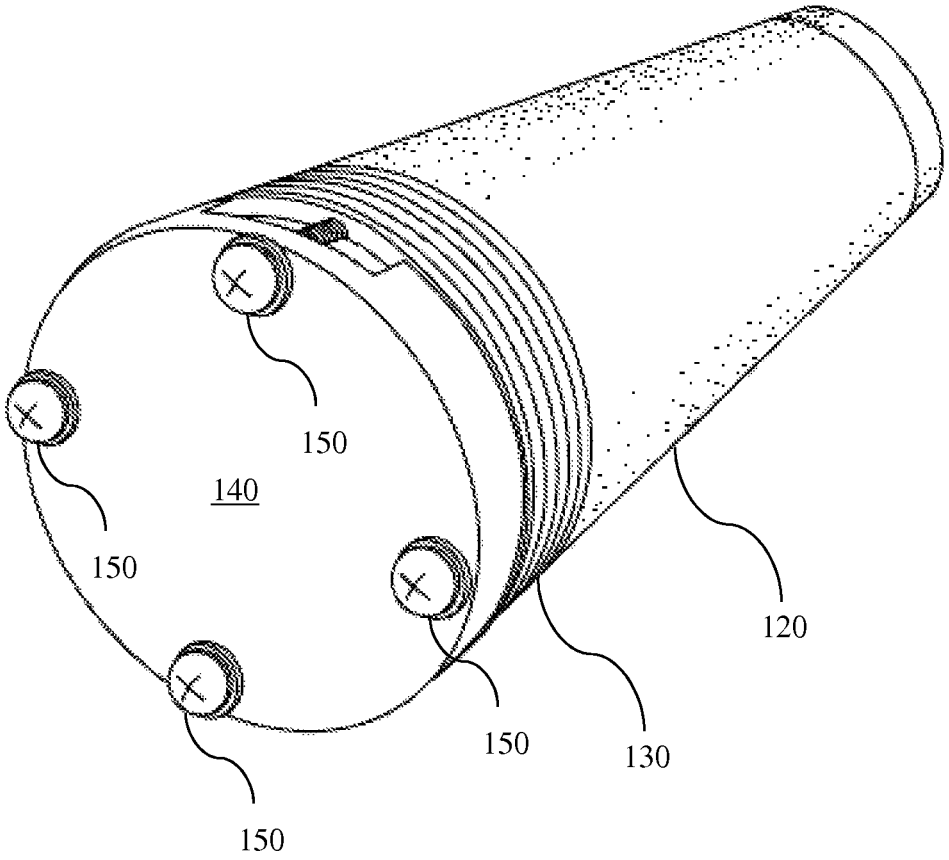
FIG. 2 is a bottom perspective view of an embodiment of an induction lamp base adapter.

FIG. 1 and FIG. 2 show a preferred embodiment of an induction lamp base adapter. At the top is the Edison screw 110, which attaches to a corresponding Edison style socket. As is well known in the industry, there are a number of various sizes for Edison screws, such as E5, E10, E11, E12, E14, E17, E26, E27, E29, E39, and E40. Below the Edison screw is the hollow cylindrical shaft 120, which can be of various lengths. As shown, the bottom portion of the cylindrical shaft 120 has male threading 130. At the bottom of the induction lamp base adapter is an end cap 140 that is screwed in by four screws to the cylindrical shaft 120. The end cap 140, as will be seen, is used to fixedly attach the induction lamp to the induction lamp base adapter. The end cap 140 is attached to the cylindrical shaft 120 by the end cap screws 150, which enter an opening in the end cap, and screw into screw holes in the bottom ring area portion of the cylindrical shaft.

Figure 3:
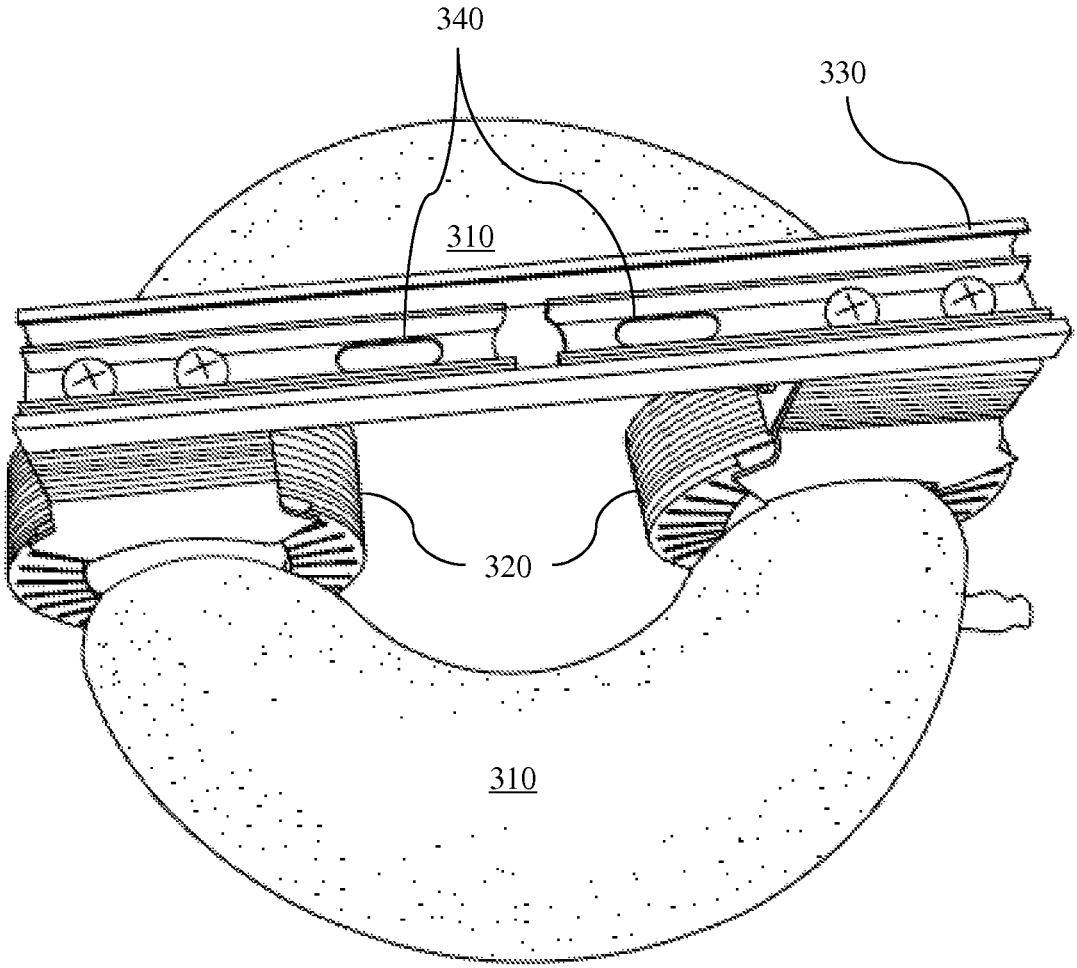
FIG. 3 is a top perspective view of an embodiment of a round induction lamp with a connector bar.

FIG. 3 shows a top perspective view of an embodiment of an induction lamp that may be attached to an induction lamp base adapter. The induction lamp is comprised of a circular induction bulb 310, induction coils 320, and handle 330. As is known to those skilled in the art, the circular induction bulb 310 is actually comprised of two halves, which work together to have the appearance of one circular induction bulb. The induction lamp bar 330 is fixed attached to the induction coils, and is designed to specifically attach to an induction lamp base adapter. In this embodiment, the induction lamp bar 330 is comprised of a crossbar that attaches to the two induction coils 320. The crossbar has two sidewalls that extend outward from the induction coils 320. Between the two sidewalls is a floor with two induction lamp bar screw openings 340. The induction lamp bar screw openings 340 are shown as elongated openings, and may also be circular openings. In this embodiment, there is also an opening in the center. The use of these openings can be seen in FIG. 4.

Figure 4:
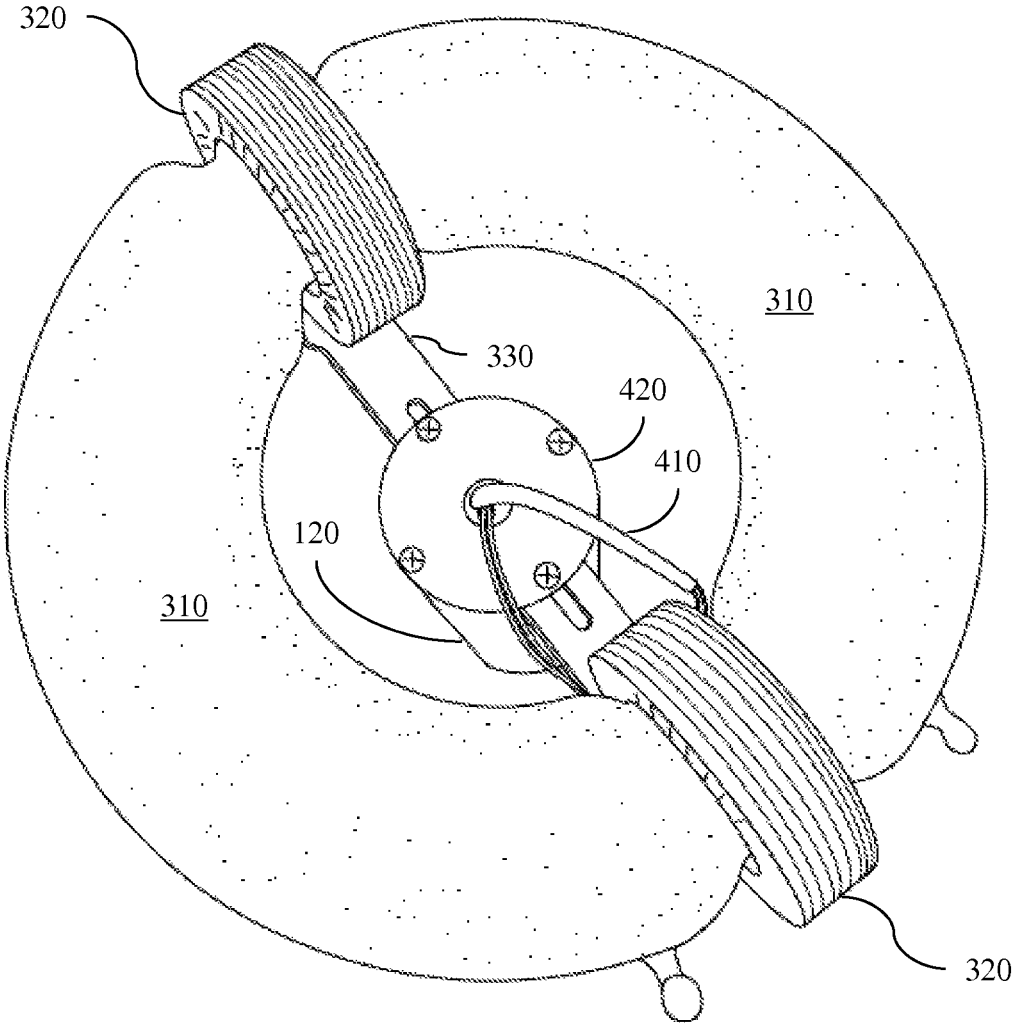
FIG. 4 is a bottom perspective view of an embodiment of an of a round induction lamp with a connector bar, attached to an induction lamp base adapter.

The end cap 140 is removed from the cylindrical shaft 120, by removing the end cap screws 150. In the preferred embodiment, the end cap 140 is circular shaped, with a sidewall that extends towards the cylindrical shaft 120. There are cut outs of the sidewall at two opposing ends of the sidewall, and the cut outs are approximately the same size as a cross section of the induction lamp bar 330. This allows for the end cap 140 to be fitted under the induction lamp bar 330, such that the induction lamp bar 330 embed into cut outs of the sidewall of the end cap 140. The end cap 140 is then attached to the cylindrical shaft 120, using the end cap screws 150. There is an end cap screw opening positioned at each cut out of the end cap 140. This allows for the end cap screws 150 positioned at the cut out, to enter through the two induction lamp bar screw openings 340. Once the end cap screws 150 are screwed in, the induction lamp bar 330 will become fixedly attached to the induction lamp base adapter. The induction lamp bar 330 is unable to twist around relative to the induction lamp base adapter due to the shape of the cutouts. In addition, the induction lamp bar 330 is unable to slide along the cutout due to the end cap screws 150 being positioned through the induction lamp bar screw opening 340. This is shown in FIG. 4.

Figure 5:
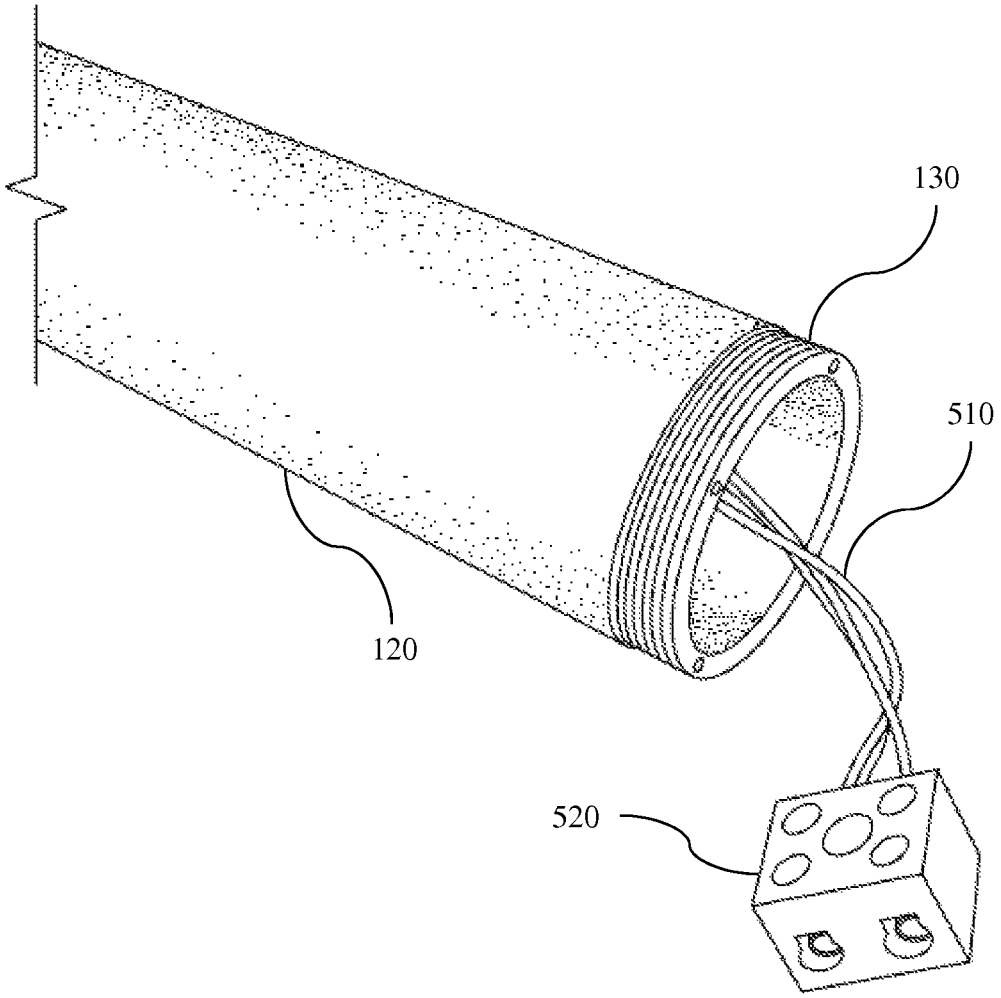
FIG. 5 is a side perspective view of an embodiment of an induction lamp base adapter with the end cap removed.

FIG. 2 shows an embodiment of the end cap 140 without a hole in the center. In contrast, FIG. 4 shows an end cap 420 with a hold in the center. Other than having a hole in the center, the end cap 420 of FIG. 4 is identical to the end cap 140 of FIG. 2. The purpose of the center hole in the end cap 420 is to allow the wiring, which runs down the inside of the cylindrical shaft 120, to come out. The wiring carries the electrical current from the Edison screw. Having the wiring exit from the hole in the end cap 420 works fine if there is loose wire, which can fit through the center hole of the end cap 420. In addition, there is also a hole in the center of the induction lamp bar 330 for allowing the wiring to pass through. However, if there is a harness 520 attached at the end of the wiring 510, such as in FIG. 5, then the size of the harness 520 may be prohibitively large to fit through a center hole in the induction lamp bar 330 and/or end cap 420. In this case, the wiring may simply exit out of the induction lamp base adapter through the cutout of the end cap 140. The harness provides the convenience of being able to quickly and easily attach to a receiving harness adapter on the induction lamp.

Figure 6:
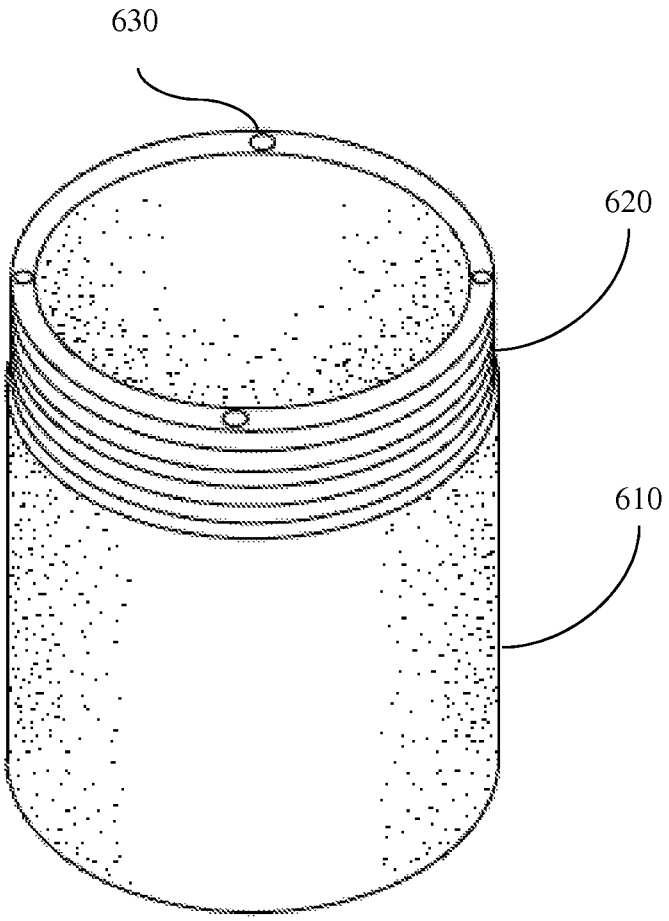
FIG. 6 is a bottom perspective view of an embodiment of an induction lamp extender.
Figure 7:
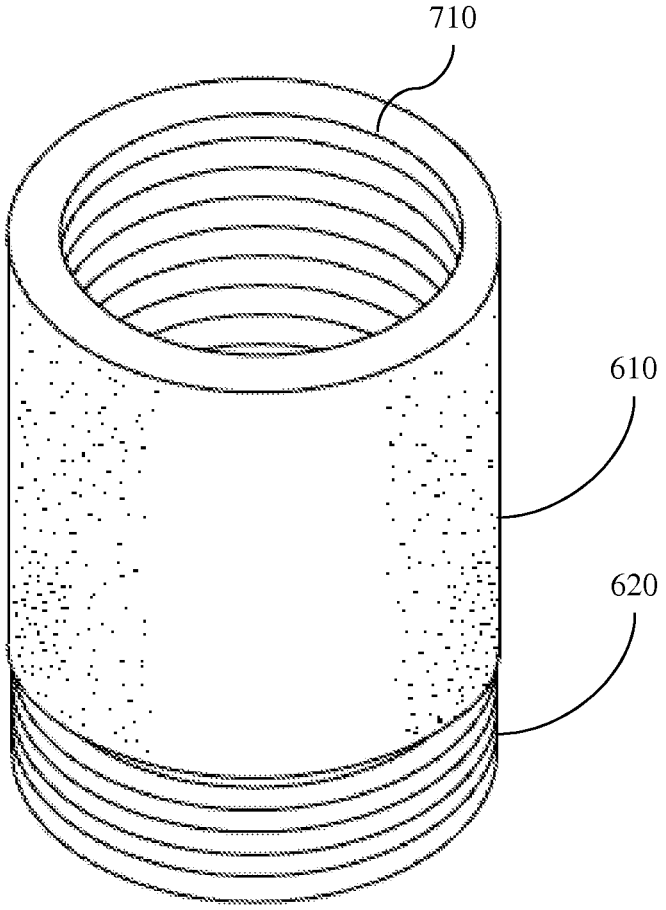
FIG. 7 is a top perspective view of an embodiment of an induction lamp extender.

The induction lamp base adapter has male threading 130 at the base of its cylindrical shaft 120. The purpose of the male threading 130 is to allow for an extension adapter to be attached. A preferred embodiment of an extension adapter can be seen in FIGS. 6 and 7. The extension adapter in FIGS. 6 and 7 has a hollow cylindrical shaft 610, with female threading 710 at the top and male threading 620 at the bottom. The bottom, or base, ring area also has end cap screw holes 630, which are positioned in the same layout as the end cap screw holes in the induction lamp base adapter.

Figure 8:
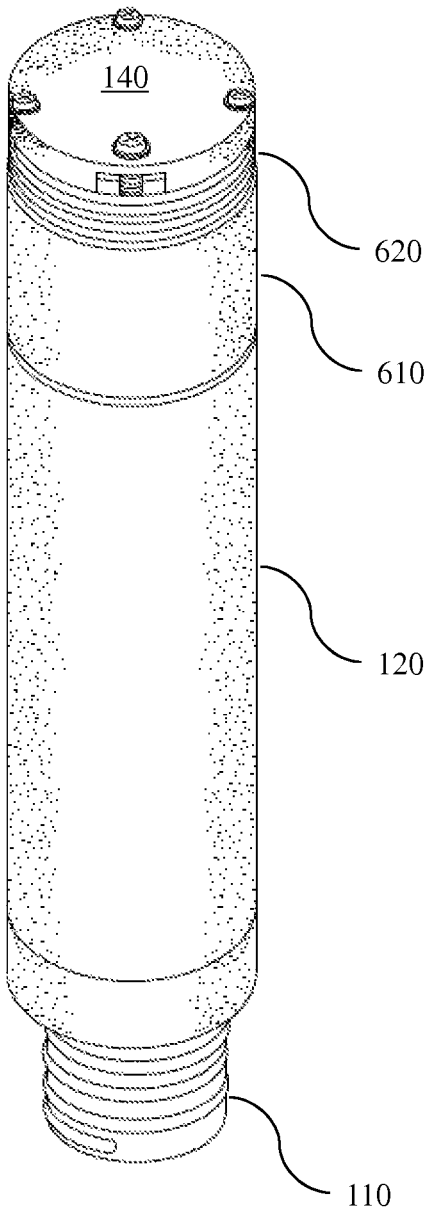
FIG. 8 is a bottom perspective view of an embodiment of an induction lamp base adapter with an induction lamp extender.

As shown in FIG. 8, the extension adapter may be screwed onto the base of the induction lamp base adapter by attaching the male threading 130 to the female threading 710. The end cap 140 can then be attached to the base of the extension adapter in the same manner as when attaching to the induction lamp base adapter. The wiring that goes down through the cylindrical shaft 120 of the induction lamp base adapter can extend down the cylindrical shaft 610 of the extension adapter. There may be various lengths of the extension adapter. In addition, multiple extension adapters can be chained together to extend the length as desired. This chaining is possible since the extension adapter also has male threading at the base, allowing it to also attach to another extension adapter.

The present invention has been described in an illustrative manner. It is to be understood that the terminology which has been used is intended to be in the nature of words of description rather than of limitation. While there have been described herein, what are considered to be preferred and exemplary embodiments of the present invention, other modifications of the invention shall be apparent to those skilled in the art from the teachings herein and, it is, therefore, desired to be secured in the appended claims all such modifications as fall within the true spirit and scope of the invention.

What is claimed is:

1. An induction lamp adapter comprising:

a hollow base cylindrical shaft with an Edison style screw at a top end, male threading on said base cylindrical shaft at a bottom end and a plurality of end cap screw holes at a ring area of said bottom end;

a hollow extension cylindrical shaft with female threading at a first end, male threading at a second end and a plurality of end cap screw holes at a ring area of said second end, wherein said female threading of extension cylindrical shaft screws onto said male threading of base cylindrical shaft;

an induction lamp fixedly attached to an induction lamp bar;

a circular end cap fixedly attached to said second end of extension cylindrical shaft with a plurality of end cap screws that screw through said circular end cap and into said plurality of end cap screw holes of said extension cylindrical shaft, wherein said induction lamp bar is clamped in between said circular end cap and said extension cylindrical shaft; and a wire carrying current from said Edison style to said induction lamp.

2. The induction lamp adapter of claim 1, wherein said induction lamp bar is fixedly attached to a plurality of induction coils of said induction lamp.

3. The induction lamp adapter of claim 2, wherein said circular end cap comprises a sidewall extending towards said extension cylindrical shaft, wherein said sidewall has at least two cut outs at two opposing ends, such that said induction lamp bar embeds into said at least two cut outs.

4. The induction lamp adapter of claim 3, wherein said induction lamp bar comprises of at least one screw opening wherein at least one of said end cap screw is screwed through said screw opening of the induction lamp bar.

5. The induction lamp adapter of claim 4 further comprising a wiring harness attached to said wire.

* * * * *